US006376997B1

(12) United States Patent
Aendekerk

(10) Patent No.: US 6,376,997 B1
(45) Date of Patent: Apr. 23, 2002

(54) CIRCUIT ARRANGEMENT

(75) Inventor: Everaard Marie Jozef Aendekerk, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/671,985

(22) Filed: Sep. 28, 2000

(30) Foreign Application Priority Data

Sep. 30, 1999 (EP) ..... 99203199

(51) Int. Cl.[7] ..... H05B 37/02

(52) U.S. Cl. ..... 315/291; 315/224; 315/247; 315/DIG. 5

(58) Field of Search ..... 315/247, DIG. 7, 315/291, 209 R, 255, 224, 254, 256, 307, DIG. 5, 276, 278

(56) References Cited

U.S. PATENT DOCUMENTS

| | | | | | |
|---|---|---|---|---|---|
| 5,223,767 | A | * | 6/1993 | Kulka | 315/209 R |
| 5,412,287 | A | * | 5/1995 | Shackle | 315/247 |
| 5,502,635 | A | * | 3/1996 | Bobel | 363/132 |
| 5,521,467 | A | * | 5/1996 | Statnic et al. | 315/247 |
| 5,801,491 | A | * | 9/1998 | Canova | 315/224 |

* cited by examiner

*Primary Examiner*—Don Wong
*Assistant Examiner*—Ephrem Alemu

(57) ABSTRACT

In a circuit arrangement for operating at least one lamp, and comprising two power feedback loops, a transformer with two primary windings and one secondary winding is included in the load circuit. The voltage present at a common terminal of the two primary windings is fed back by one of the feedback loops. The circuit arrangement can operate lamps with a lamp voltage that is much higher than the rms voltage of the mains supply generating only a limited amount of total harmonic distortion.

6 Claims, 2 Drawing Sheets

CIRCUIT ARRANGEMENT

BACKGROUND OF THE INVENTION

The invention relates to a circuit arrangement for operating a discharge lamp with a high frequency current comprising

- input terminals for connection to a source of low frequency supply voltage,
- rectifier means coupled to said input terminals for rectifying said low frequency supply voltage,
- a first circuit comprising a series arrangement of first unidirectional means, second unidirectional means and first capacitive means coupled to a first output terminal N3 of said rectifier means and a second output terminal N5 of said rectifier means,
- inverter means shunting said first capacitive means for generating the high frequency current,
- a load circuit comprising a series arrangement of inductive means, second capacitive means and means for applying a voltage to the discharge lamp, said load circuit connecting a terminal N1 of said inverter means to a terminal N2 between the first unidirectional means and the second unidirectional means, and
- a second circuit comprising third capacitive means and connecting terminal N2 to terminal N5,
- a third circuit connecting the first output terminal N3 of the rectifier means to a terminal N4 between the second unidirectional means and the first capacitive means, said third circuit comprising a series arrangement of third unidirectional means and fourth unidirectional means, and
- a fourth circuit connecting a terminal N7 between said third unidirectional means and said fourth unidirectional means to a terminal N6 that is part of the load circuit.

Such a circuit arrangement is known from WO /19578. In the known circuit arrangement the discharge lamp is simply mounted in series with the inductive means and second capacitive means comprised in the load circuit. During lamp operation the known circuit arrangement supplies a high frequency current to the lamp that is generated by the inverter. The known circuit arrangement comprises two power feedback loops. The first power feedback loop is formed by the load circuit and the first and second unidirectional means. The second power feedback loop is formed by the fourth circuit and the third and fourth unidirectional means. Due to these two power feedback loops, the known circuit arrangement generates only a small amount of THD during operation while it comprises only a relatively small amount of relatively cheap components. It has been found that the known circuit arrangement is very suitable for supplying lamps that during operation have a peak to peak lamp voltage that is smaller than the peak value of the low frequency supply voltage. In case the peak to peak voltage of the discharge lamp is increased to a value higher than the peak value of the low frequency supply voltage, THD increases and the operational conditions begin to deviate from optimal conditions.

The operating point could be restored by incorporating a transformer equipped with primary winding and a secondary winding into the means for applying a voltage to the discharge lamp. The primary winding would have to be part of the load circuit and would preferably have to be dimensioned so that the peak to peak voltage over it is roughly equal to the peak value of the low frequency supply voltage.

At the same time the secondary winding would have to be dimensioned as is necessary to generate the lamp voltage. An important disadvantage of this solution, however, is that the current in the load circuit and in the switches incorporated in the inverter becomes relatively high. In practice this means that either expensive components that are capable of carrying this relatively high current need to be used or that the components need to be cooled during operation.

Alternatively, operating point can also be restored by incorporating a voltage dividing network in the second power feedback loop. It was found, however, that the presence of such a voltage dividing network in some cases gave rise to a relatively high current in the load circuit and in the switches of the inverter. This high current is disadvantageous for the reasons outlined hereabove. In other cases it was found that the presence of a voltage dividing network made it necessary to operate the inverter at a frequency that was relatively close to the resonance frequency of the load circuit. This way of operating the inverter causes a high tolerance sensitivity of the components of the load circuit and can cause a relatively high power dissipation in the switches of the inverter.

SUMMARY OF THE INVENTION

It is an object of the present invention to provide a circuit arrangement, that causes relatively little harmonic distortion of the low frequency supply current, while the circuit arrangement is also capable of operating discharge lamps having a relatively high lamp voltage without the drawbacks of components comprised in the load circuit and the inverter having to conduct a relatively large current during lamp operation or a high tolerance sensitivity of the components of the load circuit or a relatively high power dissipation in the switches of the inverter.

A circuit arrangement according to the invention is for this purpose characterized in that the means for supplying a voltage to the discharge lamp comprise a transformer equipped with a series arrangement of two primary windings comprised in the load circuit and a secondary winding and in that terminal N6 is situated between the two primary windings.

It has been found that a circuit arrangement according to the invention can be dimensioned for a very wide range of lamp voltages in such a way that the current in the load circuit and the inverter switches is relatively low while the tolerance sensitivity of the components of the load circuit is quite acceptable.

It has also been found that a smooth operation of the circuit arrangement could be realized in case the second circuit further comprises the first capacitive means.

A smooth operation of the circuit arrangement was also found for configurations of the circuit arrangement wherein the fourth circuit comprises fourth capacitive means.

The unidirectional means preferably comprise diode means. The unidirectional means are thus realized in a very simple way.

In a preferred embodiment of a circuit arrangement according to the invention the inverter means comprise a series arrangement of a first switching element, terminal N1 and a second switching element, and a drive circuit DC coupled to the switching elements for generating a drive signal for rendering the switching elements alternately conducting and non-conducting. The inverter is thus realized in a relatively simple and dependable way.

Preferably the transformer is constructed in such a way that the first primary winding L3 and the second primary winding L4 are formed by one physical winding and terminal N6 is formed as a tap on the winding. In that way the transformer is constructed in a relatively simple and compact way.

BRIEF DESCRIPTION OF THE DRAWING

Embodiments of the invention will be explained in more detail with reference to a drawing, in which.

DESCRIPTION OF THE PREFERRED EMBODIMENTS

Figure 1:
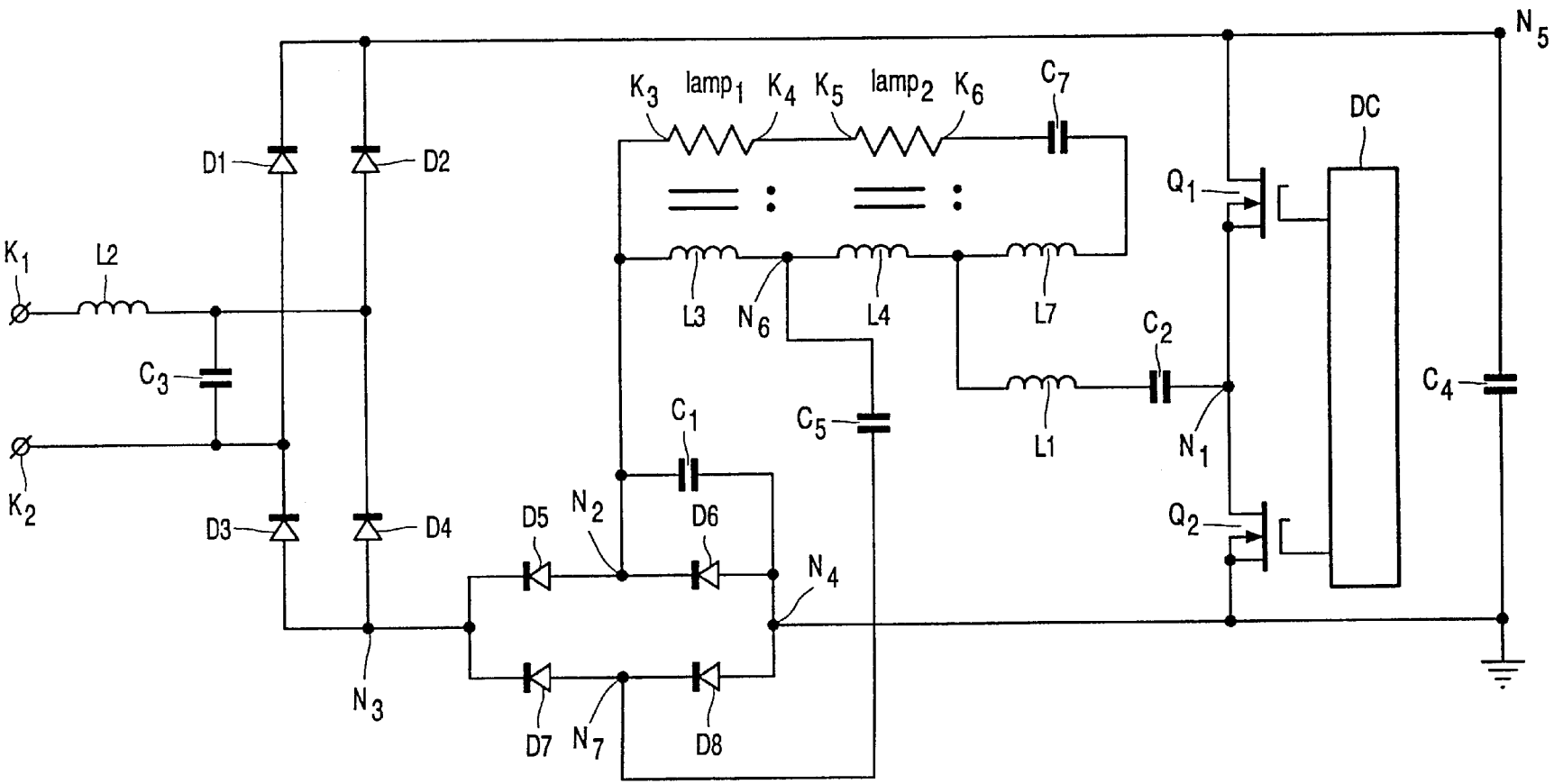
FIG. 1 is a simplified schematic diagram of a first embodiment of a circuit arrangment according to the present invention with a series arrangement of discharge lamps lamp1 and lamp2 connected to the circuit arrangement.

In FIG. 1 K1 and K2 are input terminals for connection to a source of low frequency supply voltage. L2 is an inductor that forms an input filter together with capacitor C3. Diodes D1–D4 are rectifier means for rectifying said low frequency supply voltage. In this embodiment diodes D5 and D6 form first and second unidirectional means respectively. Capacitor C4 forms a first capacitive means and forms together with diodes D5 and D6 a first circuit. Switching elements Q1 and Q2 together with drive circuit DC form inverter means. Drive circuit DC is a circuit part for generating drive signals for rendering switching elements Q1 and Q2 conducting and non-conducting. Inductor L1, capacitor C2, primary windings L3 and L4, secondary winding L7 and terminals K3, K4, K5 and K6 for connecting to a discharge lamp together form a load circuit. Primary windings L3 and L4 and secondary winding L7 form a autotransformer. The autotransformer together with terminals K3, K4, K5 and K6 form means for applying a voltage to the discharge lamps. In the embodiment shown in FIG. 1 inductor L1 forms inductive means and capacitor 2 forms second capacitive means. Capacitor C1 forms third capacitive means. Capacitor C1 and capacitor C4 together form a second circuit. Diodes D7 and D8 form third and fourth unidirectional means respectively. The series arrangement of diodes D7 and D8 forms a third circuit. Capacitor C5 forms fourth capacitive means and also a fourth circuit.

Input terminals K1 and K2 are connected by means of a series arrangement of inductor L2, capacitor C3. A first side of capacitor C3 is connected to a first input terminal of the rectifier bridge and a second side of capacitor C3 is connected to a second input terminal of the rectifier bridge. A first output terminal N3 of the rectifier bridge is connected to a second output terminal N5 of the rectifier bridge by means of a series arrangement of diode D5, diode D6 and capacitor C4. N2 is a common terminal of diode D5 and diode D6. N4 is a common terminal of diode D6 and capacitor C4. Terminal N2 is connected to terminal N4 by means of capacitor C1. The series arrangement of diodes D5 and D6 is shunted by a series arrangement of diodes D7 and D8. N7 is a common terminal of diodes D7 and D8. Capacitor C4 is shunted by a series arrangement of switching elements Q1 and Q2. A control electrode of switching element Q1 is connected to a first output terminal of drive circuit DC. A control electrode of switching element Q2 is connected to a second output terminal of drive circuit DC. N1 is a common terminal of switching element Q1 and switching element Q2. Terminal N1 is connected to terminal N2 by means of a series arrangement of respectively capacitor C2, inductor L1 and primary windings L4 and L3. N6 is a common terminal of primary winding L3 and primary winding L4. Terminal N6 is connected to terminal N7 by means of capacitor C5. The series arrangement of primary windings L3 and L4 is shunted by a series arrangement of secondary winding L7, capacitor C7 terminal K6, discharge lamp "lamp2", terminal K5, terminal K4, discharge lamp "lamp1" and terminal K3.

The operation of the circuit arrangement shown in FIG. 1 is as follows.

When input terminals K1 and K2 are connected to the poles of a source of a low frequency supply voltage, the rectifier bridge rectifies the low frequency supply voltage supplied by this source so that a DC-voltage is present over capacitor C4 serving as a buffer capacitor. Drive circuit DC renders the switching elements Q1 and Q2 alternately conducting and non-conducting and as a result a substantially square wave voltage having an amplitude approximately equal to the amplitude of the DC-voltage over capacitor C4 is present at terminal N1. The substantially square wave voltage present at terminal N1 causes an alternating current to flow through capacitor C2, inductor L1 and primary winding L4. A first part of this alternating current flows through primary winding L3 and terminal N2. The remaining part of this alternating current flows through capacitor C5 and terminal N7. As a result both at terminal N2 as well as at terminal N7 voltages having the same frequency as the substantially square wave voltage are present. These voltages present at terminal N2 and a terminal N7 cause a pulsatory current to be drawn from the supply voltage source also when the voltage over capacitor C4 is higher than the momentary amplitude of the rectified low frequency supply voltage. For this reason the power factor of the circuit arrangement has a relatively high value and the total harmonic distortion of the supply current is relatively low. During operation a voltage having the same frequency as the substantially square wave voltage present at terminal N1 is present over the series arrangement of primary windings L3 and L4 and secondary winding L7. As a result a current having the same frequency flows through the series arrangement of the discharge lamps "lamp1" and "lamp2".

In a practical realization of an embodiment as shown in FIG. 1, the dimensioning was as follows: L1=580 $\mu$H, F, C1=18 nF, C2=200 nF, C3=200 nF, C4=22 $\mu$F, C5=18 nF and C7=200 nF. The transformer was so dimensioned that L3/(13+L4)=0.66 while (L3+L4+L7)/(L3+L4)=1.33. With this embodiment two low pressure mercury discharge lamps with a nominal power of 58 Watt were operated. The lamp voltage of these lamps was 110 Volt for each lamp. The frequency of the substantially square wave voltage was approximately 50 kHz. The low frequency supply voltage source was a European mains supply supplying 230 Volts r.m.s with a frequency of 50 Hz. The current was through inductor L1 was 910 mA r.m.s. The total harmonic distortion was far less than 20%, which is in agreement with IEC 1000-3-2. It was found that when the same low pressure mercury discharge lamps were operated in parallel by means of a known circuit arrangement as described in WO/19578 and equipped with a substantially identical input filter, the current through the inductor L1 was 1240 mA r.m.s., leading to a much higher power dissipation in the switches.

It be mentioned that similar results were obtained for a configuration of the circuit arrangement slightly differing from the configuration shown in FIG. 1 in that capacitor C1 connects terminal N2 to terminal N5 instead of terminal N4. In this slightly different configuration capacitor C1 forms third capacitive means and a second circuit.

Figure 2:
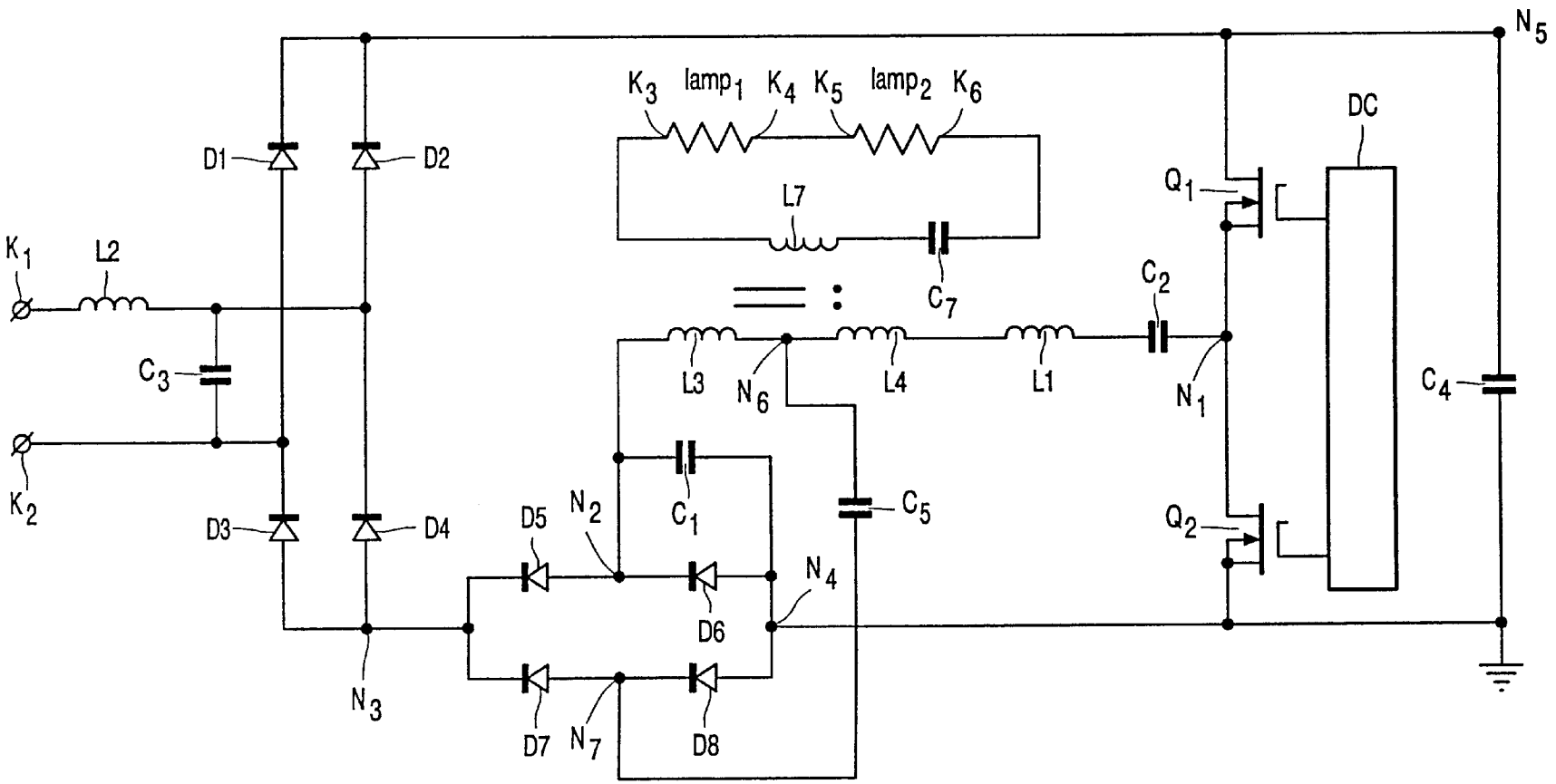
FIG. 2 is a simplified schematic diagram of a second embodiment of a circuit arrangement according to the invention with a series arrangement of the two discharge lamps lamp1 and lamp2 connected to the circuit arrangement.

The embodiment shown in FIG. 2 is to a large extent similar to the embodiment shown in FIG. 1. Similar components and circuit parts are indicated with the same reference signs in both figures. In the embodiment in FIG. 2 the secondary winding L7 comprised in the transformer in the load circuit is coupled only magnetically and not electrically to the two primary windings. The secondary winding L7 is shunted by a series arrangement of a capacitor C7 and the discharge lamps "lamp1" and "lamp2".

The operation of the embodiment shown in FIG. 2 is similar to that of the embodiment shown in FIG. 1 and will not be described separately.

What is claimed is:

1. Circuit arrangement for operating a discharge lamp with a high frequency current comprising:

input terminals for connection to a source of low frequency supply voltage, rectifier means coupled to said input terminals for rectifying said low frequency supply voltage, a first circuit comprising a series arrangement of first unidirectional means, second unidirectional means and first capacitive means coupled to a first output terminal (N3) of said rectifier means and a second output terminal (N5) of said rectifier means, inverter means shunting said first capacitive means for generating the high frequency current, a load circuit comprising a series arrangement of inductive means, second capacitive means and means for applying a voltage to the discharge lamp, said load circuit connecting a terminal (N1) of said inverter means to a terminal (N2) between the first unidirectional means and the second unidirectional means, and a second circuit comprising third capacitive means and connecting terminal (N2) to terminal (N5), a third circuit connecting the first output terminal (N3) of the rectifier means to a terminal (N4) between the second unidirectional means and the first capacitive means, said third circuit comprising a series arrangement of third unidirectional means and fourth unidirectional means, and a fourth circuit connecting a terminal (N7) between said third unidirectional means and said fourth unidirectional means to a terminal (N6) that is part of the load circuit, said means for supplying a voltage to the discharge lamp comprising a transformer including a series arrangement of two primary windings included in the load circuit and a secondary winding, said terminal (N6) being situated between the two primary windings.

2. Circuit arrangement according to claim 1, wherein the second circuit includes the first capacitive means.

3. Circuit arrangement according to claim 1, wherein the fourth circuit includes fourth capacitive means.

4. Circuit arrangement according to claim 1, wherein the unidirectional means comprise diode means.

5. Circuit arrangement according to claim 1, wherein said inverter means comprises a series arrangement of a first switching element, terminal (N1) and a second switching element, and a drive circuit (DC) coupled to the switching elements for generating a drive signal for rendering the switching elements alternately conducting and non-conducting.

6. Circuit arrangement according to claim 1, wherein the first primary winding (L3) and the second primary winding (L4) are formed by one physical winding and terminal (N6) is formed as a tap on the winding.

* * * * *